United States Patent [19]

Glen

[11] Patent Number: 5,041,035

[45] Date of Patent: Aug. 20, 1991

[54] MOUNTING AND CONTROL OF OUTBOARD MOTORS

[75] Inventor: Robert D. Glen, Forest Hill, England

[73] Assignee: E.P. Barrus Limited, United Kingdom

[21] Appl. No.: 493,157

[22] Filed: Mar. 14, 1990

[30] Foreign Application Priority Data

Mar. 16, 1989 [GB] United Kingdom ..... 8906062

[51] Int. Cl.[5] ..... B63H 21/26

[52] U.S. Cl. ..... 440/87; 74/500.5; 74/502.4

[58] Field of Search ..... 440/63, 87; 114/144 R, 114/146; 74/480 B, 502.4, 502.6, 500.5; 60/700

[56] References Cited

U.S. PATENT DOCUMENTS

| | | | |
|---|---|---|---|
| 3,258,927 | 7/1966 | Herbert . | |
| 3,905,242 | 9/1975 | Hoffman . | |
| 3,918,311 | 11/1975 | Maier . | |
| 4,007,647 | 2/1977 | Carlson | 74/502.4 |
| 4,650,429 | 3/1987 | Boda | 440/87 |

FOREIGN PATENT DOCUMENTS

| | | | |
|---|---|---|---|
| 1215268 | 4/1960 | France . | |
| 100092 | 6/1984 | Japan | 440/87 |
| 2031362 | 4/1980 | United Kingdom | 440/87 |
| 2060809 | 5/1981 | United Kingdom | 74/502.4 |

*Primary Examiner*—Sherman Basinger
*Assistant Examiner*—Thomas J. Brahan
*Attorney, Agent, or Firm*—Andrus, Sceales, Starke & Sawall

[57] ABSTRACT

A single tiller 7 is used to control two outboard motors mechanically connected to a manner know per se for simultaneous steering. Twist grip 8 turns drum 10 to wind on cables 11 and 12. Each of these cables enters a connector (13 or 14 respectively) where it is connected to two further cables (24,25 or 26,27 respectively) whereby cables 24, 26 are longer and 25, 27 are shorter. The longer cables 24, 26 are attached to the throttle control of the motor further from the tiller 7 and the shorter cables 25,27 to the nearer motor throttle control, in each case so that the throttle can be opened or shut by a positive pull-pull action, whereby lighter construction can be achieved. More motors and cables can be used if desired.

3 Claims, 2 Drawing Sheets

MOUNTING AND CONTROL OF OUTBOARD MOTORS

Figure 1:
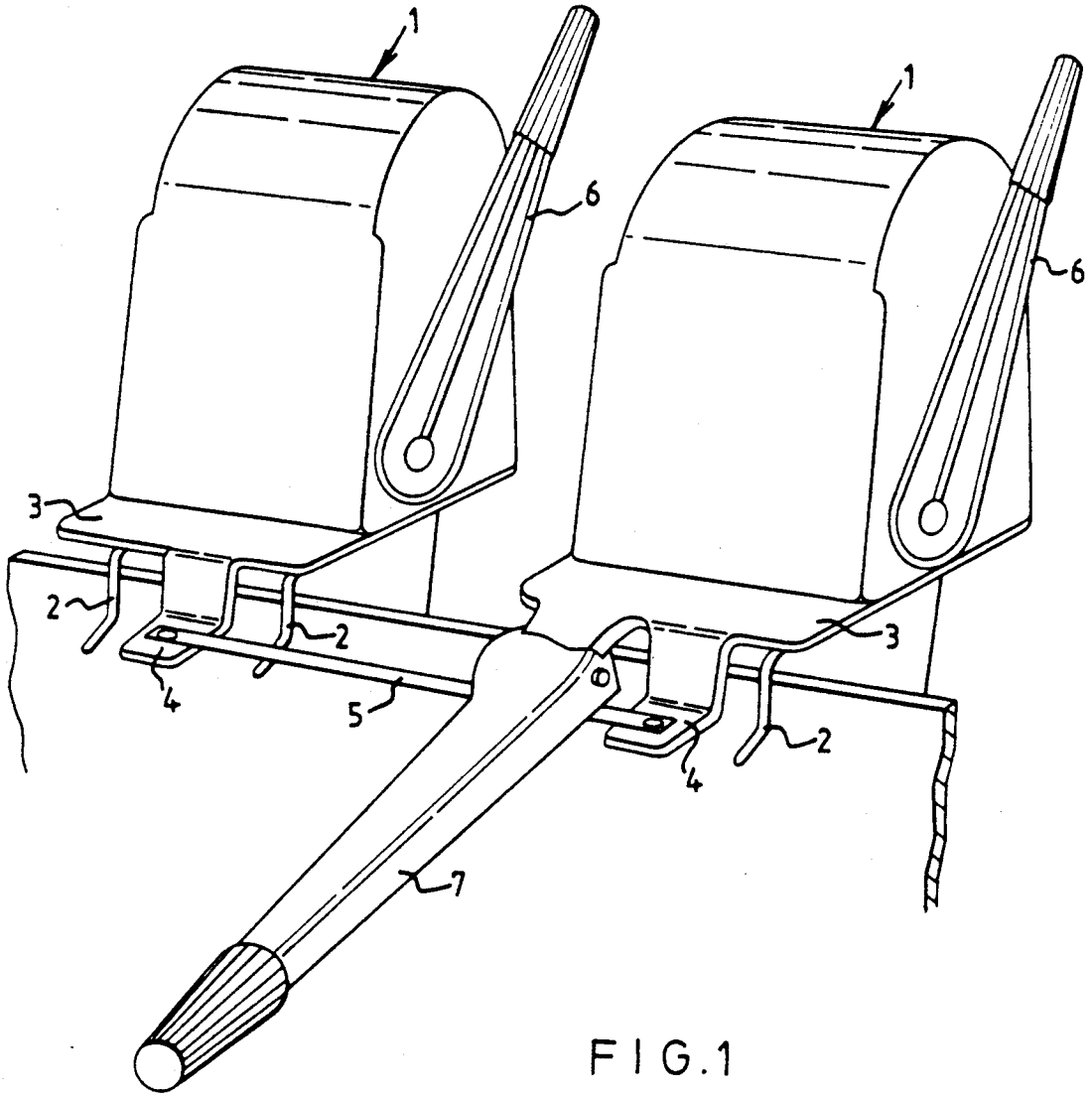

This invention relates to outboard motors for marine craft, and in particular to the alignment, steering, and control of two or more such motors.

It is of course well known to provide an outboard motor as a fitment to a marine craft, usually at the stern. Typically this motor is bolted or clamped to the transom and provides motive power to a submerged propeller from an internal combustion engine at its upper part. Steering is effected by swinging the whole motor round a vertical pivoting axis using a forwardly-projecting steering tiller, and power to the motor is typically controlled by a twist grip upon this steering tiller connected to a conventional throttle. Remote control of such steering and power is also well-known, where the operator is remote from the engines.

It is also well known to mount two or more such motors side by side to provide increased power. The invention is particularly concerned with such arrangements. For convenience of description it will refer to a twin motor arrangement, it being understood however that similar arrangements for a triple (or more) motor mounting also fall within the scope of the invention as defined below.

When two motors are mounted side by side some provision must be made for convenient control of steering and power of both motors. One known arrangement provide a detachable bar to connect the two tillers, so that movement of one tiller automatically involves movement of the other tiller. Typically, with such an arrangement a separate throttle control is envisaged.

Another known arrangement, as described in our earlier G. B. Patent 2031362 is to provide an additional single tiller. Such a tiller is connected to one of the motors, and protrude forwardly essentially along the longitudinal median line of the vessel. The two motors are themselves interconnected by a tie rod, adjustable in length, between two motor mounting brackets. Push pull throttle cables extend from the additional tiller to each motor, and an optional joint gear change unit with connecting cables may be attached to one side of the additional tiller. In use, the individual tiller arms are folded up out of the way, and the single additional tiller arm is used to control both steering and power.

Such an arrangement, whilst readily useable in that only one tiller protrudes forward from the motors, is somewhat elaborate and expensive. Accordingly, it has recently been proposed by the present applicants to utilise a further type of interconnection, comprising two parts. One part is a rod interconnecting the steering brackets of the two motors, so that as one motor turns for steering, the other motor turns with it. The other part is a rod connected to the twist portion of the relative throttle grips, so that as one twist portion turns to control the throttle, the other twist portion also turns.

In this arrangement, instead of a single tiller there still remains both existing tillers, but either can be used to control both engines.

In a study of such twin motor systems, we have realised that joint control arrangements can vary in accordance with the size, cost, and intended use of the craft, and that moreover their effectiveness is also linked to the accuracy of alignment of the two motors and to the accessibility of other controls such as gear levers. The present invention, while being generally concerned with the control and use of a twin or like motor system for marine craft, is particularly concerned with such areas of improvement.

The present invention is particularly related to a form of additional single tiller assembly for the control of two or more motors.

In one aspect, the invention consists an installation of two or more outboard motors of the type having an additional single tiller control whereby motors are simultaneously steered and simultaneously controlled as to throttle in which installation a rotary shaft extends along the additional tiller from a twist grip and carries at its inward end a pulley or drum to which are attached two operating cables, whereby rotation of the pulley or drum in one sense will pull a first cable attached thereto and in the other sense will pull a second cable attached thereto: the installation being characterised by further comprising cable connector members, one connected to the first cable as an incoming cable and one cable to the second as an incoming cable, each such connector member possessing a group of ongoing cables, equivalent in number to the number of motors, attached to the single incoming cable, whereby rotation of the pulley or drum and consequent pulling of one or other of the first and second cables will pull one or other of the groups of cables and connection of one ongoing cable of each such group to a throttle control of an individual motor allows for pull-pull operation of the said throttle control.

Preferably, there are two such motors and correspondingly a pair of cables attached to each.

Preferably, of the ongoing pair of cables attached to each connector, one is shorter and one is longer, whereby both shorter cables can be attached to the nearer motor and both longer such cables to the further motor.

The provision of a pull-pull mechanism, which is lighter than the cable mechanism necessary for pull-pull operation, renders this invention particularly suitable for use with lightweight motors.

Figure 2:
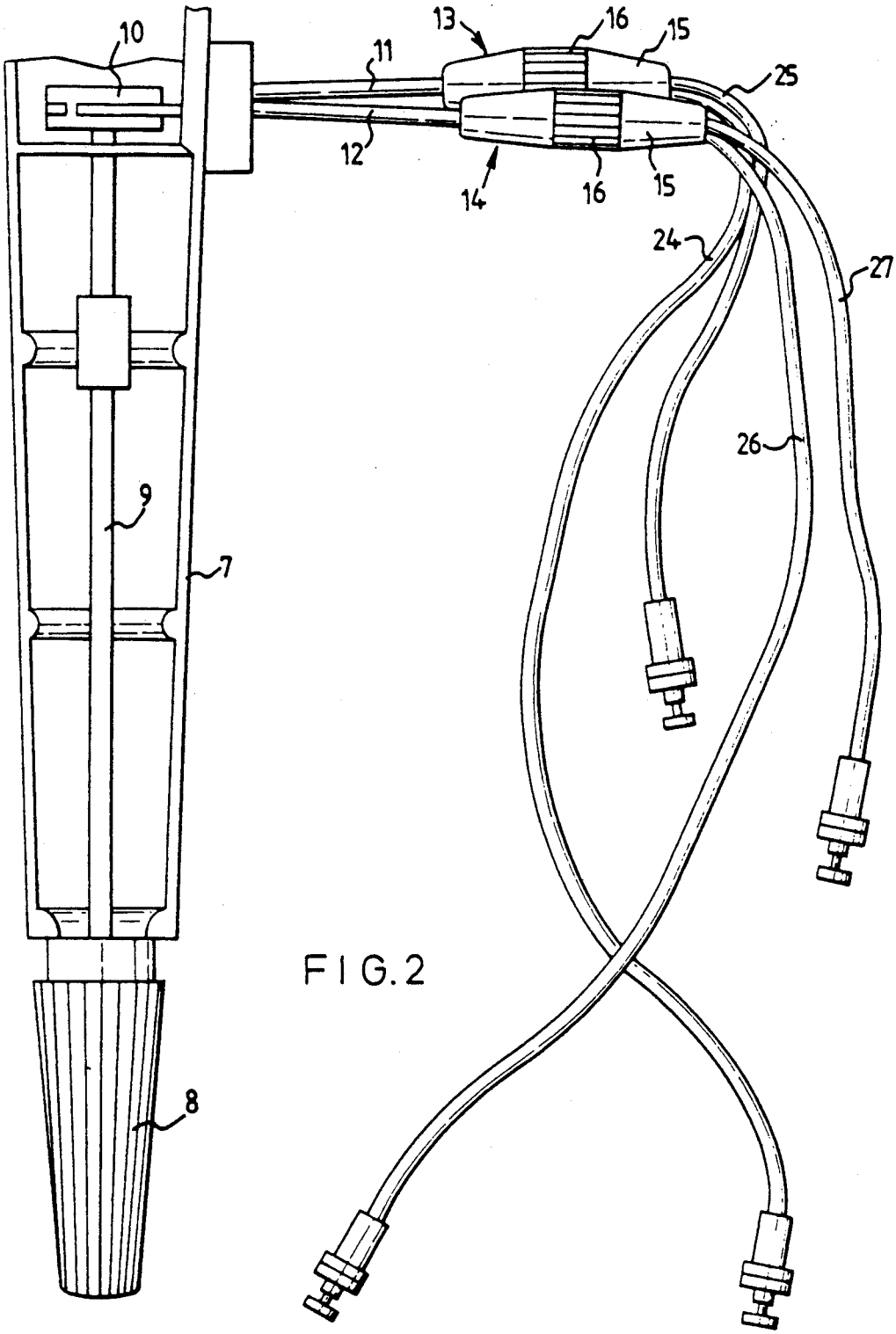

The invention will be further described with reference to the accompanying drawings, in which:

FIG. 1 shows in general terms the arrangement of two motors with a single additional central tiller, the control drives of said motors to their throttles being omitted, and FIG. 2 shows from the underside an additional tiller in accordance with the invention with throttle control cables in accordance with the invention attached thereto.

In FIG. 1, a general type of mounting for two outboard motors can be seen. Each motor 1 is mounted by engine mountings 2 at the transom or stern of the vessel, and is pivotable on its underlying mounting plate 3 around a vertical axis. Simultaneous pivoting is achieved by the interconnection of two forwardingly extending mounting brackets 4, by means of a transom rod 5. The normal control tiller 6 of each motor is shown folded up, i.e. in an inoperative position. A single additional tiller 7 position is shown extending forwardly, along from more or less the median line of the vessel. The above arrangement will be understood in more detail from a consideration of our British Patent No. 2,031,362A.

As shown in FIG. 1 the arrangement can obviously be used to effect joint steering of the two motors 1. It is however also necessary to effect throttle control of both motors from the single twist grip 8 on additional tiller 7. Hitherto, this has been done by having the twist grip 8 turn an internal drum or gearing to which two cables are attached. One such cable goes to one motor and one to the other, but they operate in a push-pull mode in each case. Thus, both cables are either pushed out to the same extent or pulled back to the same extent and therfore both throttles operate accordingly.

This is a relatively simple attachment and lends itself in particular to larger motors necessitating a generally larger scale attachment and consequently thicker and more resistant cables. We have established, however, that a different arrangement can advantageously be used for light motors, permitting a pull-pull operation of the throttle control in each case and using thinner and more flexible cables. Although in some ways it may not be so easy to assemble rapidly, there are situations in which such a single tiller arrangement is assembled perhaps only once a season (e.g. for a hobby fisherman) so the relatively light and inexpensive coupling provided according to the invention is advantageous over the prior art.

FIG. 2 shows the nature of the throttle coupling in accordance with the invention. The twist grip 8 is attached to a longitudinal shaft 9, so that turning the twist grip turns the shaft 9 about its longitudinal axis. At the inner end, the shaft 9 possesses a drum or pulley 10, and to this drum or pulley 10 is attached the ends of two cables 11, 12. (Each cable is of course in the form of a central wire which moves in relation to a stationary external sheath as in the well known Bowden cable). The cables 11 and 12 both comes out to one side of the tiller and each more or less immediately enters a connector member 13, 14. Each connector member 13, 14 is essentially identical, and comprises an elongate housing 15, which can be unscrewed at or about the middle at 16 and an internal holding block.

The holding block 17 ensures that as the wire cable core is pulled in relation to its sheath two wires of each ongoing cable each become pulled in relation to their sheath.

The same arrangement also applies to the other cable coming away from the tiller so that there are in total four ongoing cables 24, 25, 26 and 27. It will be thus be apparent that if one cable 11 is pulled i.e. if the grip is twisted in one direction there are two free wire ends e.g. 24, 25 that become pulled in, and if the other cable is pulled i.e. if the twist-grip is turned in the other direction the other two cable ends 26, 27 will be pulled in.

The cable ends are therefore attached, one from each pair, e.g. 24/26 and 25/27 to the throttle control (not shown) of a motor. For this purpose it will be found convenient if as a shown one of two ongoing cables e.g. 24, 26 in each pair is longer and the other one e.g. 25, 27 is shorter. Thus, for connection to a given throttle, there are provided either two shorter cables or two longer cables. This both facilitates attachment, since one motor is typically somewhat farther away from the tiller than the other, and aids identification.

By suitable attachment to the throttle control, a positive pull-pull type action can be given which is the same on each throttle and is the same in either direction.

I claim:

1. A tiller control arrangement for simultaneously steering and simultaneously operating the throttle controls of an installation of two or more outboard motors comprising:

a tiller (7) having a twist grip (8);

a rotary shaft (9) extending along the tiller from the twist grip (8), said rotary shaft attached at its outer end to the twist grip and having a pulley (10) attached to its inner end such that the rotation of the twist grip causes rotation of the shaft and pulley;

first and second operating cables (11, 12) attached to the pulley (10) such that rotation of the pulley in one direction pulls the first cable (11) and rotation of the pulley in the other direction pulls the second cable (12);

a first cable connector (13) connected to the first cable (11) as an incoming cable and providing attachment of the first cable (11) to the ends of a first group (24, 25) of ongoing cable equivalent in number to the number of motors (1);

a second cable connector (14) connected to the second cable (12) as an incoming cable and providing attachment of the second cable (12) to the ends of a second group (26, 27) of ongoing cables equivalent in number to the number of motors (1);

the opposite end of one of each of said first group (24, 25) of ongoing cables connected to the throttle control of one of said motors (1);

the opposite end of one of each of said second group (26, 27) of ongoing cable connected to the throttle control of one of said motors (1) in opposition to the ongoing cable of said first group (24, 25);

whereby rotation of the pulley (10) in one direction and the other direction will pull the first group (24, 25) of ongoing cable and the second group (26, 27) of ongoing cables, respectively, to provide simultaneous pull-pull operation of the throttle controls of said motors.

2. A tiller control arrangement as claimed in claim 1 comprising two such motors 1 and correspondingly a pair of cable (24, 26 or 25, 27) attached to each motor.

3. A tiller control arrangement as claimed in claim 2 wherein of the ongoing cables (24, 25 or 26, 27) attached to each connector (13, 14) one pair (24, 26) is shorter and one pair (25, 27) is longer.

* * * * *